US005560722A

United States Patent [19]

Kawaguchi

[11] Patent Number: 5,560,722

[45] Date of Patent: Oct. 1, 1996

[54] TAPE UNIT HAVING RIBBON END TAPE

[75] Inventor: Takashi Kawaguchi, Aichi-ken, Japan

[73] Assignee: Brother Kogyo Kabushiki Kaisha, Nagoya, Japan

[21] Appl. No.: 336,075

[22] Filed: Nov. 7, 1994

[30] Foreign Application Priority Data

Feb. 28, 1994 [JP] Japan ..... 6-029819

[51] Int. Cl.[6] ..... B41J 33/02

[52] U.S. Cl. ..... 400/238; 400/241; 400/241.1; 400/242

[58] Field of Search ..... 400/238, 208, 400/237, 241, 241.1, 248, 242; 428/212, 213, 214, 215, 216

[56] References Cited

U.S. PATENT DOCUMENTS

| | | | |
|---|---|---|---|
| 4,016,321 | 4/1977 | McIntyre, Jr. | 428/16 |
| 4,265,553 | 5/1981 | Hatsell | 400/238 |
| 4,339,486 | 7/1982 | Shimamoto et al. | 428/40 |
| 4,475,830 | 10/1984 | Schaefer | 400/238 |
| 4,666,320 | 5/1987 | Kobayashi et al. | 400/241.1 |
| 4,775,578 | 10/1988 | Hayashi et al. | 428/216 |
| 4,983,058 | 1/1991 | Nagae . | |
| 5,269,612 | 12/1993 | Shimoha et al. | 400/238 |
| 5,304,008 | 4/1994 | Asakura et al. | 400/208 |

*Primary Examiner*—John S. Hilten
*Attorney, Agent, or Firm*—Oliff & Berridge

[57] ABSTRACT

An end tape for connecting a thermal recording material such as an ink ribbon or a heat-sensitive paper to a tape spool is formed of a material having a glass transition point (Tg) of 90° C. or higher. Even if the end tape is continuously heated at its same position by a thermal head, the end tape is not melted.

15 Claims, 7 Drawing Sheets

TAPE UNIT HAVING RIBBON END TAPE

BACKGROUND OF THE INVENTION

1. Field of the Invention

The present invention relates to a tape unit for use in recording by a thermal recording system and, more particularly, to an end tape for connecting a thermal recording material for forming a printed image and a core for winding the thermal recording material.

2. Description of the Related Art

A thermal recording material and a thermal recording system using it are easier to handle than any other recording materials and recording systems using them now in practical application. Further, a thermal recording device to which the thermal recording material and the thermal recording system are applied is relatively inexpensive. Accordingly, the thermal recording material and the thermal recording system are widely used for outputting in a computer, facsimile, recorder, etc.

The thermal recording material is generally classified into an ink ribbon for use in a thermal transfer system for transferring an original image to a recording medium by using a thermal print head (thermal head) and a heat-sensitive recording sheet such as a heat-sensitive paper or a heat-sensitive plastic film on which a printed image is to be directly recorded by heat from the thermal head.

In the thermal transfer system typically using such an ink ribbon, the ink ribbon having a given width and a length of several meters is wound around a reel to form a roll, and this roll is set in a printing device for practical use. In a printing operation, the roll is suitably unwound to feed the ink ribbon to the thermal head, and heat from the thermal head is applied to the ink ribbon from the side opposite to an ink coated surface of the ink ribbon according to a desired input image of characters, thereby forming a printed image on the recording medium facing the ink coated surface of the ink ribbon. Such a printing device using an ink ribbon is disclosed as a tape writer in U.S. Pat. No. 4,927,278 (Japanese Utility Model Publication No. Hei 4-32290).

The heat-sensitive recording sheet inclusive of the heat-sensitive paper and the heat-sensitive plastic film can also form a printed image by using a similar printing device as mentioned above with the exception that no recording medium is needed.

The thermal recording material is gradually consumed to an end as the printing operation proceeds. Until the thermal recording material comes to an end during the printing operation, there occurs no problem in printing. However, at the time the thermal recording material is fully consumed, the heat from the thermal head is concentrated at one position to bring about an adverse effect on any members surrounding the thermal head.

More specifically, when the ink ribbon is not connected to the reel, the ending of the ink ribbon results in separation of the ink ribbon from the reel. Accordingly, the free ink ribbon is fed to pass between the thermal head and a platen opposed to the thermal head. Thereafter, the ink ribbon is absent between the thermal head and the platen. If an operator does not know the ending of the ink ribbon and continues the printing, the thermal head comes into direct contact with the platen and continues to apply heat to the platen. As a result, a contact portion of the platen contacting the thermal head becomes very high in temperature and thus damaged or deformed, causing a change in printing conditions. In this event, the platen must be replaced in order to obtain a good print quality again. Further, the thermal head itself is possibly damaged.

Disclosed in U.S. Pat. No. 4,983,058 (Japanese Utility Model Publication No. Hei 4-34048) is a tape cassette storing a printing tape and an ink ribbon for thermal transferring an original image to the printing tape. That is, the original image such as characters are printed on the printing tape through the ink ribbon by using a thermal head. An end tape is attached to a trailing end of the printing tape in order that an operator can confirm the ending of the printing tape. When the end tape is visually perceived by the operator, the ending of the printing tape is confirmed by the operator to stop printing on the printing tape. Even if the operator fails to visually perceive the end tape and continues the printing on the printing tape after the ending of the printing tape, there is no possibility that the end tape may be melted by the heat from the thermal head because the ink ribbon is present between the end tape and the thermal head to absorb the heat from the thermal head. However, in case the ink ribbon and the reel are connected together by using an end tape similar to that described in U.S. Pat. No. 4,983,058 mentioned above, the end tape is fed from the reel after the ink ribbon is fully used for printing. Immediately thereafter, the feed of the end tape is stopped to cause a phenomenon that the thermal head continues to heat the end tape at its same position. In this event, the conventional end tape is possibly melted by the heat from the thermal head to stick to the thermal head. Such a deposition of the melted end tape on the thermal head disables transmission of the heat from the thermal head to the thermal recording material in the next printing operation, thus rendering printing impossible. It is very difficult to remove such a deposition stuck to the thermal head, and an organic solvent or the like must be used to clean the thermal head, causing an adverse effect on any members surrounding the thermal head. In some cases, the end tape is possibly cut to be entangled within the tape cassette or the printing device. Further, it is apparent that this problem also occurs in case the thermal recording material is directly connected to the reel without using the end tape.

Although this problem may be eliminated by providing a mechanism for sensing the ending of the thermal recording material in the printing device, such a mechanism is very expensive and complicated in structure, thus impeding easy provision for the mechanism in the printing device.

SUMMARY OF THE INVENTION

It is accordingly an object of the present invention to provide an end tape which is not melted even when continuously heated at the same position by a thermal head.

According to the present invention, there is provided a tape unit comprising an elongated thermal recording material for forming a printed image by a thermal recording system employing a thermal print head; a core for winding the thermal recording material; and an end tape for connecting a trailing end of the thermal recording material to the core, the end tape being formed of a material having a glass transition point (Tg) of 90° C. or higher.

The thermal recording material may be a heat-sensitive tape such as a heat-sensitive paper or a heat-sensitive plastic film on which the printed image is to be directly recorded by heat from the thermal print: head; the core may be detachably mounted in a tape cassette adapted to be set in a printing device having the thermal print head for printing characters on the heat-sensitive tape and having feeding means for feeding the heat-sensitive tape; and the end tape may have a length greater than a length of a feed path of the heat-sensitive tape from the core to a tape eject portion of the tape cassette.

Alternatively, the thermal recording material may be a heat-sensitive ink ribbon for transferring an original image to a recording medium by heat from the thermal print head to record the printed image on the recording medium; the core may be detachably mounted in a tape cassette adapted to be set in a printing device having the thermal print head for printing characters on the recording medium and having feeding means for feeding the ink ribbon; and the end tape may have a length greater than a length of a feed path of the ink ribbon from the core to the thermal point head.

According to the present invention, the end tape is formed of a material having a glass transition point (Tg) of 90° C. or higher. Accordingly, even when the end tape is continuously heated at its same position by the thermal print head after ending of the thermal recording material and stopping of the travel thereof, the end tape is not melted by the heat from the thermal print head, thereby preventing deposition of a foreign matter to the thermal print head. As a result, there occurs no need of cleaning or repairing the thermal print head.

As described above, the end tape is formed of a material having a glass transition point (Tg) of 90° C. or higher. Accordingly, even after the full length of the thermal recording material used for printing stops traveling and the end tape is continuously heated at its same position by the thermal print head in such a stopped condition, there occurs no fusion of the end tape due to the heat from the thermal print head, thereby preventing cutting of the end tape or contamination of the thermal print head.

BRIEF DESCRIPTION OF THE DRAWINGS

Preferred embodiments of the present invention will be described in detail with reference to the following figures, wherein.

DETAILED DESCRIPTION OF PREFERRED EMBODIMENTS

A first preferred embodiment of the present invention will be described with reference to FIGS. 1 to 6. A tape unit according to a first preferred embodiment is used with a tape printing device for printing characters such as letters and symbols on a printing tape as a printing medium.

Figure 1:
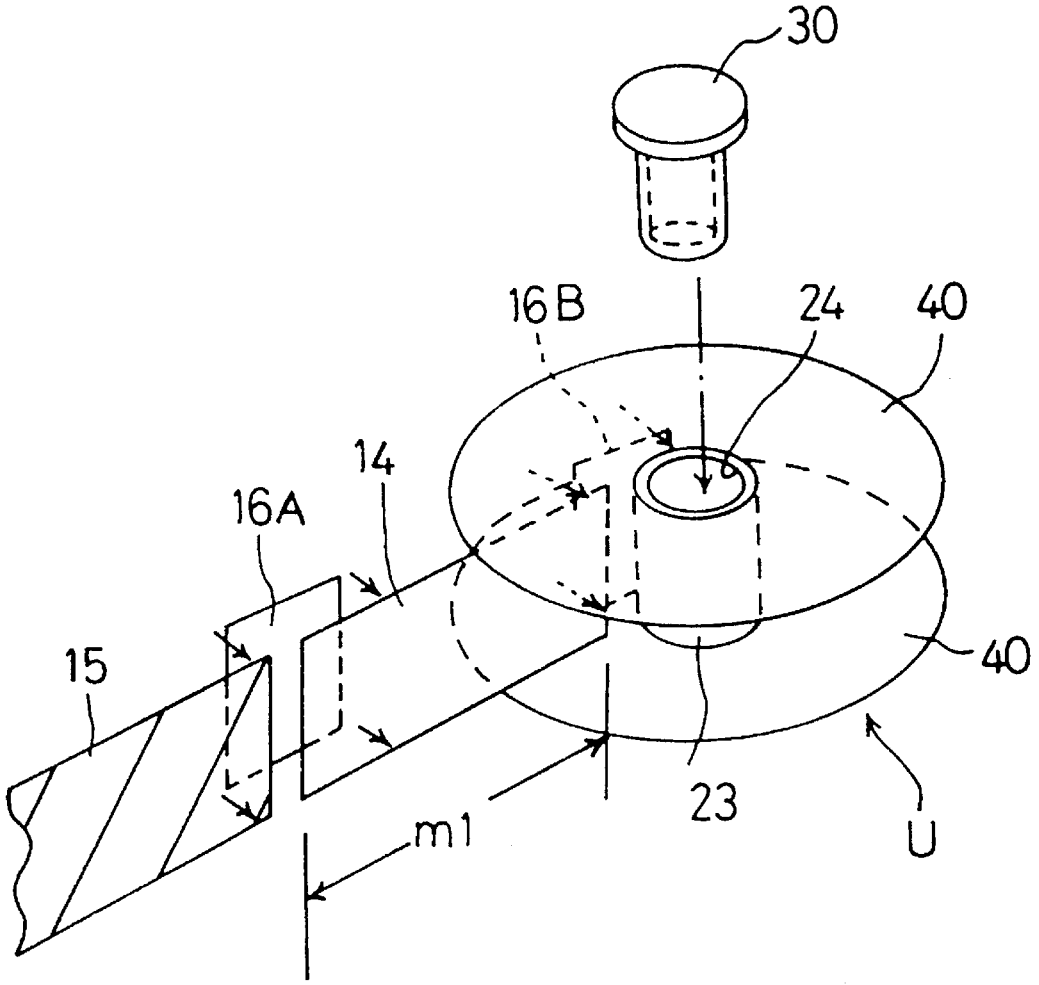
FIG. 1 is a partially cutaway perspective view of a tape unit according to a first preferred embodiment of the present invention.

Referring to FIG. 1, reference character U generally denotes the tape unit. The tape unit U is composed of an end tape 14, a heat-sensitive tape 15 corresponding to the thermal recording material in the present invention, a tape spool 23 corresponding to the core in the present invention, and first and second adhesive tapes 16A and 16B.

Figure 5:
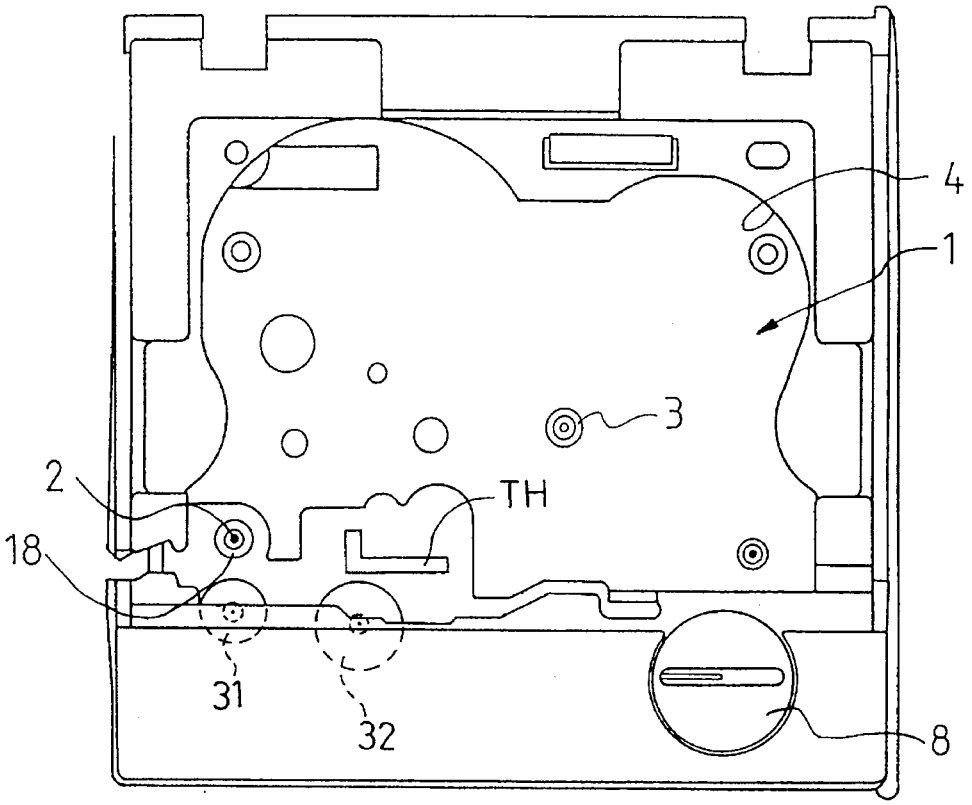
FIG. 5 is a top plan view of a tape cassette receiving portion for receiving the tape cassette.

It is essential that the end tape 14 is formed from a heat resistant sheet that is not melted by heat from a thermal head TH (see FIG. 5). Preferably, the end tape 14 is formed of a material having a glass transition point (Tg) of 90° C. or higher. More preferably, the end tape 14 is formed of a PI (polyimide) film having a thickness of 25 μm.

Other materials such as PS (polysulfone), PES (polyether sulfone), PPS (polyphenylene sulfide), PEEK (polyetherether ketone), PAR (polyarylate), PEN (polyethylene naphthalate), APA (p-aromatic polyamide), PAI (polyamideimide), POD (polyoxazole), PHY (polyhydantoin), PPA (polyparabanic acid), PEI (polyether imide), or mixtures thereof can also be used to form the end tape 14.

The end tape 14 has a length ml, and a tape feed path formed from the tape spool 23 to a tape eject portion A of a tape cassette CS (see FIG. 3) to be hereinafter described has a length m2. The length m1 of the end tape 14 is set greater than the length m2 of the tape feed path. Preferably, the length m2 is about 18 cm, and accordingly the length m1 is set to 20 cm.

The heat-sensitive tape 15 is preferably formed from a heat-sensitive sheet composed of a base sheet and a heat-sensitive coloring layer applied to an upper surface of the base sheet. The base sheet may be formed of paper or plastics such as polyester, polystyrene, polyvinyl chloride, polymethacrylate, their copolymers, polyethylene, and polypropylene. The heat-sensitive coloring layer may be composed of a leuco dye, a developer reacting with the leuco dye to color the leuco dye, a color accelerator for accelerating the coloring reaction between the leuco dye and the developer, a binder for binding the leuco dye and the developer, an auxiliary such as aluminum hydroxide or calcium carbonate, for example, and other conventional additives. Such coloring layer compositions are conventional. A typical coloring layer composition may comprise about 5 to 15% by weight leuco dye, about 5 to 15% by weight developer, about 1 to 10% by weight color accelerator, about 60 to 85% by weight binder, about 1 to 10% by weight auxiliary, and about 1 to 10% by weight conventional additives. A releasing paper may be attached through an adhesive layer to a lower surface of the heat-sensitive sheet (i.e., a lower surface of the base sheet). The releasing paper may have a silicone coating on one surface thereof attached to the heat-sensitive sheet. The heat-sensitive tape 15 may be a commercially available heat-sensitive paper (PLAIN THERMAX PAPER made by NEW OJI PAPER CO., LTD.).

Both the end tape 14 and the heat-sensitive tape 15 may be elongated tapes having the same given width, e.g., 9 mm, 12 mm, 18 mm, or 24 mm. A trailing end of the heat-sensitive tape 15 and a leading end of the end tape 14 are firmly bonded, together by the first adhesive tape 16A, and a trailing end of the end tape 14 is firmly bonded to an outer circumference of the tape spool 23 by the second adhesive tape 16B. The end tape 14 and the heat-sensitive tape 15 thus bonded together at their ends are wound around the tape spool 23 in such a manner that the releasing paper of the heat-sensitive tape 15 faces outside. Accordingly, the thermal recording surface of the heat-sensitive tape 15 faces inside to be protected from heat, light, etc.

Further, a pair of annular seals 40 are attached on the upper and lower surfaces of the roll of the end tape 14 and the heat-sensitive tape 15 wound around the tape spool 23. An adhesive is applied on the opposed inside surfaces of the annular seals 40 to adhere to the upper and lower surfaces of the roll, thereby preventing slack of the end tape 14 and the heat-sensitive tape 15 wound around the tape spool 23 to maintain a proper rolled condition.

Figure 4:
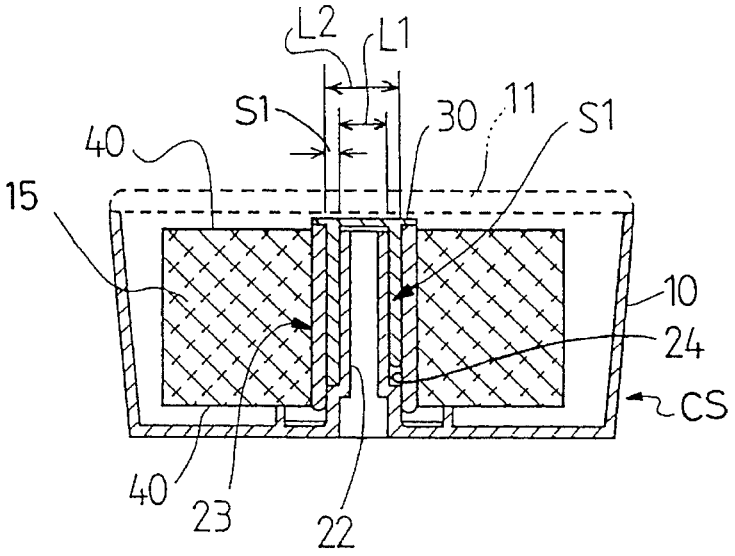
FIG. 4 is a vertical sectional view of the tape cassette, illustrating the internal structure of the tape unit.

Referring to FIG. 4, the tape spool 23 has a central spool hole 24 having a diameter L2. Reference numeral 10 denotes a cassette case of the tape cassette CS to be hereinafter described, and a tape support shaft 22 stands from a bottom wall of the cassette case 10. The tape support shaft 22 has an outer diameter L1 smaller than the inner diameter L2 of the tape spool 23. Accordingly, an annular gap S1 is defined by the difference between the outer diameter L1 of the tape support shaft 22 and the inner diameter L2 of the tape spool 23. A cylindrical cap 30 having a closed top is fitted with the annular gap S1 from the top of the tape spool 23. A wall thickness of a cylindrical portion of the cap 30 is set to (L2–L1) so as to allow rotation of the tape spool 23 around the tape support shaft 22 without looseness. On the top of the cap 30 there is provided an indication of color of characters that can be colored by the heat-sensitive tape 15 wound around the tape spool 23.

The structure of the tape cassette CS for storing the tape unit U will now be described with reference to FIGS. 2 and 3.

Figure 2:
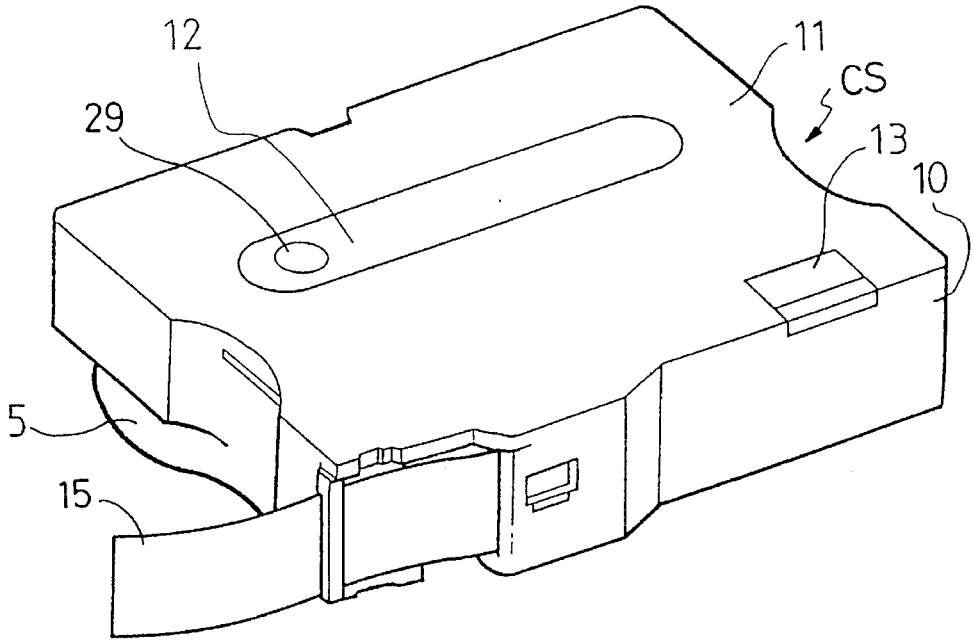
FIG. 2 is a perspective view of a tape cassette storing the tape unit shown in FIG. 1.

Referring to FIG. 2, the tape cassette CS is generally composed of the cassette case 10 and a cassette cover 11 detachably mounted on the cassette case 10 through a releasing portion 13 and a pawl member or the like (not shown). A tape check portion 12 formed of a transparent resin plate is provided at a central position of the cassette cover 11, so that an operator can check a residual quantity of the heat sensitive tape 15 stored in the tape cassette CS, a color to be developed by the heat-sensitive tape 15, etc. from the outside of the tape cassette CS through the tape check portion 12. Further, the tape check portion 12 is provided with a sight portion 29 for allowing the operator to visually perceive the top of the cap 30 fitted with the tape spool 23, so that the operator can see the indication of color provided on the top of the cap 30 through the sight portion 29.

The bottom wall of the cassette case 10 is formed with a downward projecting portion 5. As will be hereinafter described, the projecting portion 5 of the cassette case 10 is fitted with a recess 4 formed in a tape cassette receiving portion 1 of the tape printing device (see FIGS. 5 and 6).

Figure 3:
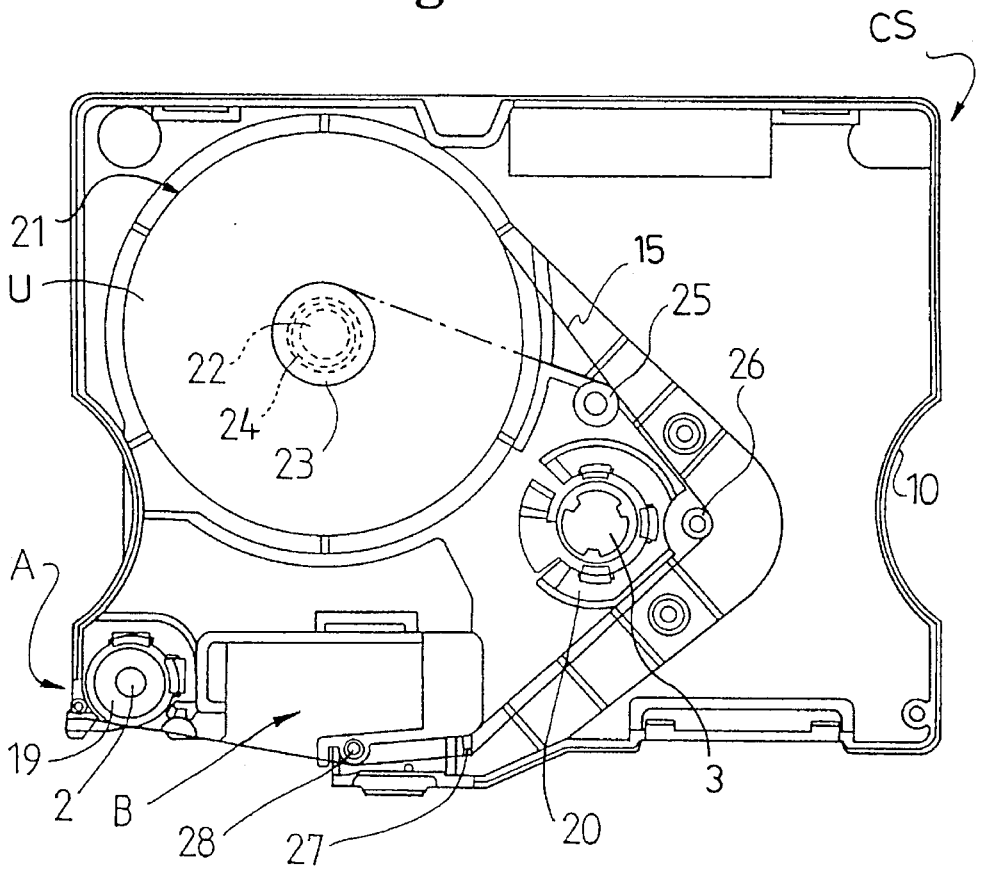
FIG. 3 is a top plan view of the tape cassette with a cassette cover removed.

Referring to FIG. 3 which shows the internal structure of the tape cassette CS, a tape storing portion 21 for storing the tape unit U is formed in the cassette case 10 at a left upper position thereof as viewed in FIG. 3. The tape support shaft 22 (see FIG. 4) is formed at the center of the tape storing portion 21 so as to upward project from the bottom wall of the cassette case 10. The tape spool 23 around which the end tape 14 and the heat-sensitive tape 15 are wound is rotatably supported through the spool hole 24 around the tape support shaft 22. The heat-sensitive tape 15 and the end tape 14 wound around the tape spool 23 stored in the tape storing portion 21 are guided by a plurality of tape guides 25, 26, 27, and 28 to the tape eject portion A of the cassette case 10. In the vicinity of the tape eject portion A there is provided a tape feed roller 19 for feeding the heat-sensitive tape 15 and the end tape 14. The tape feed roller 19 cooperates with a tape feed auxiliary roller 31 provided in the tape cassette receiving portion 1 (see FIG. 5) to forcibly eject the heat-sensitive tape 15 and a part of the end tape 14.

An opening portion B is defined in the vicinity of the tape guide 28, so as to receive the thermal head TH provided in the tape cassette receiving portion 1 (see FIG. 5). That is, when setting the tape cassette CS in the tape cassette receiving portion 1, the thermal head TH standing in the tape cassette receiving portion 1 is relatively inserted into the opening portion B of the tape cassette CS.

The structure of the tape printing device employing the tape unit U according to the present invention will now be described with reference to FIGS. 5 and 6. FIG. 5 is an enlarged plan view of the tape cassette receiving portion 1 of the tape printing device, and FIG. 6 is a fragmentary perspective view of a tape writer P as the tape printing device at the tape cassette receiving portion 1.

Figure 6:
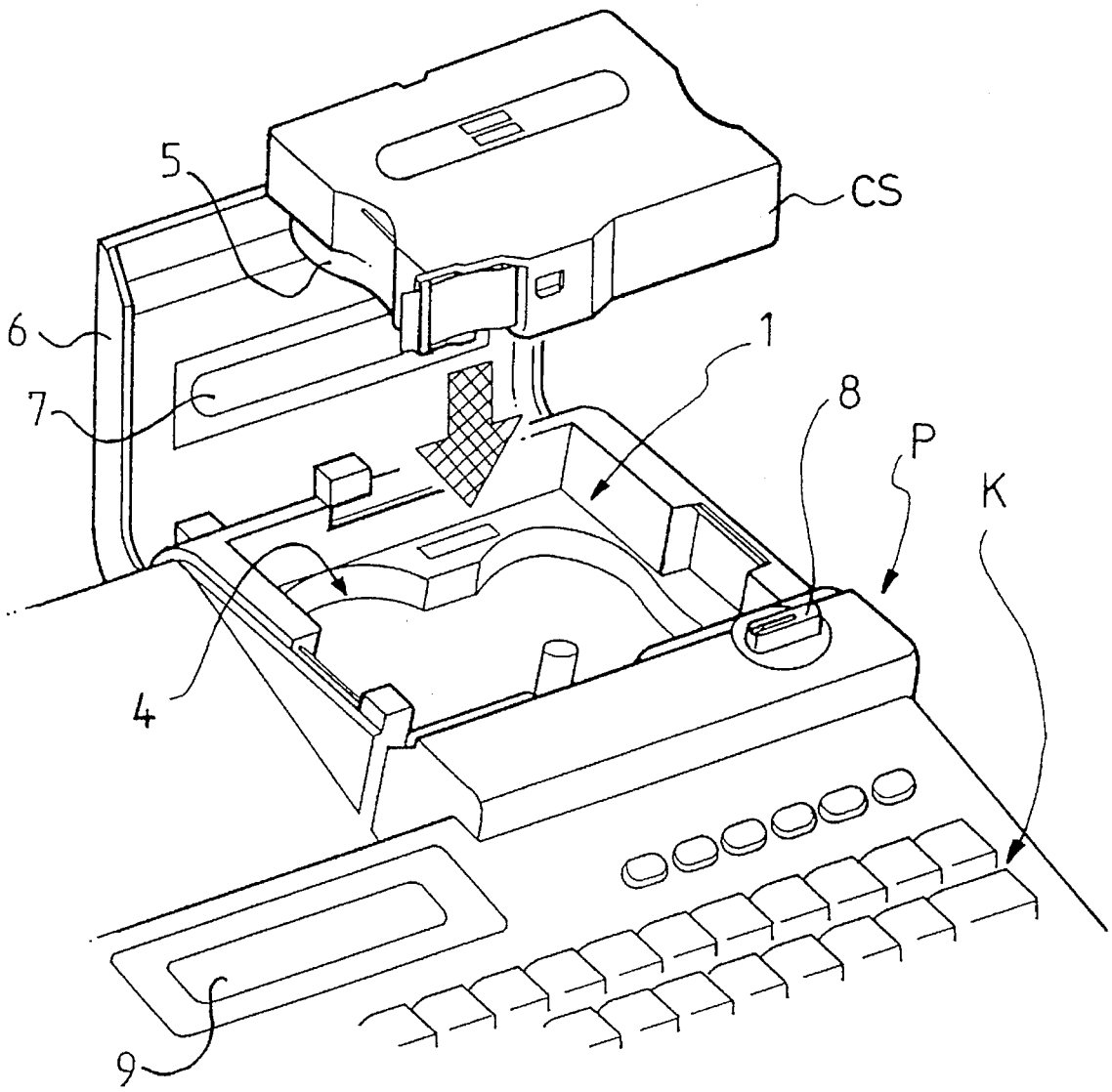
FIG. 6 is a fragmentary perspective view of a tape writer having the tape cassette receiving portion shown in FIG. 5.

Referring to FIG. 6, the tape cassette receiving portion 1 is formed at a right rear position of the tape writer P as viewed in FIG. 6. A plurality of kinds of tape cassettes CS can be selectively received in the tape cassette receiving portion 1.

Referring to FIG. 5, a tape feed shaft 2 to be rotatably driven by a tape feed motor (not shown) is located at a left lower position in the tape cassette receiving portion I as viewed in FIG. 5. A drive cam 18 is fixed to the tape feed shaft 2. When setting the tape cassette CS in the tape cassette receiving portion 1, the drive cam 18 comes into engagement with the tape feed roller 19 (see FIG. 3) rotatably provided in the tape cassette CS. The tape feed auxiliary roller 31 cooperating with the tape feed roller 19 is rotatably provided at a position opposed to the tape feed roller 19 so that the heat-sensitive tape 15 and the end tape 14 stored in the tape cassette CS are sequentially nipped between the tape feed roller 19 and the tape feed auxiliary roller 31. Accordingly, when the tape feed shaft 2 is driven, the tape feed roller 19 is rotated to thereby feed the heat-sensitive tape 15 and the end tape 14 nipped between the tape feed roller 19 and the tape feed auxiliary roller 31. The tape feed roller 19 provided in the tape cassette CS constitutes a part of the feeding means according to the present invention, which also includes the tape feed shaft 2, the drive cam 18, and the tape feed auxiliary roller 31.

The thermal head TH corresponding to the thermal print head according to the present invention is fixedly provided at a position upstream of the feeding means in respect of the tape feed path. A platen 32 is rotatably provided at a position opposed to the thermal head TH so as to be biased against the thermal head TH. Accordingly, the heat-sensitive tape 15 fed by the tape feed roller 19 and the other feeding members is pressed against the thermal head TH by the platen 32, and is heated by the thermal head TH to print characters on the heat-sensitive tape 15 as being fed.

A drive shaft 3 is rotatably provided in the vicinity of the center of the tape cassette receiving portion 1. The drive shaft 3 is rotated in interlocking relationship with the tape feed shaft 2 through a gear mechanism (not shown). A noise suppressor spool 20 (see FIG. 3) provided in he tape cassette CS is engaged with the drive shaft 3 and is rotatably driven thereby. Although the drive shaft 3 corresponds to a take-up shaft for winding an ink ribbon as used in a conventional tape cassette, the drive shaft 3 preferably does not take part in the feeding operation of the heat-sensitive tape 15, but the noise suppressor spool 20 is engaged with the drive shaft 3 to thereby suppress a noise due to rotation of the drive shaft 3.

The bottom surface of the tape cassette receiving portion 1 is formed with the recess 4 (see FIG. 6). The recess 4 is so designed as to receive the projecting portion 5 formed on the bottom surface of the tape cassette CS storing the heat-sensitive tape 15 and the end tape 14 having a large width. In the case where the heat-sensitive tape 5 and the end tape 14 have a small width, it is unnecessary to form the projecting portion 5 on the bottom surface of the tape cassette CS.

A cover 6 is pivotally mounted on a body of the tape writer P at a rear position of the tape cassette receiving portion 1 so as to open and close the tape cassette receiving portion 1. A transparent window 7 is formed at a substantially central position of the cover 6 so as to face the tape check portion 12 of the tape cassette CS in the closed condition of the cover 6. Accordingly, the operator can visibly check the kind of the heat-sensitive tape 15 and a residual quantity of the heat-sensitive tape 15 through the transparent window 7 in the closed condition of the cover 6.

Further, a rotary lock member 8 is provided on the body of the tape writer P at a front position of the tape cassette receiving portion 1. The rotary lock member 8 allows the cover 6 to be opened or closed through a locking structure not shown. Further, a keyboard K including various keys is provided on the front side of the tape cassette receiving portion 1, and a liquid crystal display 9 is provided on the rear side of the keyboard K at a left lower position with respect to the tape cassette receiving portion 1 as viewed in FIG. 6. Accordingly, various characters inclusive of letters and symbols input from the any keys of the keyboard K are displayed on the liquid crystal display 9 to allow the operator to edit the characters to be printed on the heat-sensitive tape 15 through the thermal head TH (see FIG. 5).

The following example illustrates the operation of the above preferred embodiment employing the tape unit U, the tape cassette CS, and the tape writer P by way of example will be described.

EXAMPLE

A polyimide film having a length of 20 cm, a width of 12 mm, and a thickness of 25 μm as the end tape 14 and a heat-sensitive paper having a length of 2 m and a width of 12 mm as the heat-sensitive tape 15 are bonded together at their ends by the first adhesive tape 16A, and the end tape 14 is bonded at its trailing end to the outer circumference of the tape spool 23 having an outer diameter of 12 mm and a height of 12 mm. Then, the end tape 14 and the heat-sensitive tape 15 thus bonded together are wound around the tape spool 23 to form the tape unit U. The tape unit U is stored into the cassette case 10 to form the tape cassette CS. The tape cassette CS is set in the tape cassette receiving portion 1 of the tape writer P (P-touch made by Brother Industries, Ltd.). Then, a print test is carried out by using this tape writer P.

When printing is started, the heat-sensitive tape 15 is fed from the tape spool 23 and is guided by the tape guides 25, 26, 27, and 28 to pass between the thermal head TH and the platen 32 during which desired characters are printed on the heat-sensitive tape 15. Thereafter, the heat-sensitive tape 15 is ejected from the tape eject portion A. At the time when the full length (2 m) of the heat-sensitive tape 15 is fed from the tape spool 23, the end tape 14 is next fed from the tape spool 23. At the time when the full length (20 cm) of the end tape 14 is fed from the tape spool 23, the tape feed is stopped. As previously mentioned, the length m1 of the end tape 14 is greater than the length m2 of the feed path from the tape spool 23 to the tape eject portion A. Therefore, the end tape 14 comes into contact with the thermal head TH and a leading part of the end tape 14 is ejected from the tape eject portion A in this stopped condition.

In this stopped condition where the end tape 14 is in contact with the thermal head TH, the print operation is repeated twenty times to apply heat from the thermal head TH to the end tape 14. As a result, no fusion occurred in the end tape 14. Furthermore, no trouble with the thermal head TH such as deposition of a foreign matter on the thermal head TH is observed. In addition, after this repeated print operation, the print test is carried out again by using this thermal head TH. As the result, a good printed image is formed on the heat-sensitive tape 15 with no problems.

COMPARISON

A PET (polyethylene terephthalate) film (Tg: 70° C.) having a thickness of 25 μm is used as the end tape to carry out a print test in substantially the same conditions as those in the above Example. As the result, the PET film is melted to stick to the thermal head TH. Further, after the repeated print operation, the print test is carried out again by using this thermal head TH. As the result, a good printed image is not formed because a part of the dots forming the printed image could not be formed. Further, it is very difficult to clean off the deposition on the thermal head TH.

As described above, the end tape 14 of the tape unit U according to this first preferred embodiment preferably formed of a material having a glass transition point (Tg) of 90° C. or higher. Accordingly, even when heat from the thermal head TH is continuously applied to the end tape 14 at its same position, there is no possibility that the end tape 14 may be melted to stick to the thermal head TH, causing contamination of the thermal head TH, or may be cut to be entangled with any members surrounding the thermal head TH. Accordingly, even at the ending of the heat-sensitive tape 15, a good condition of the tape writer P can be maintained.

Furthermore, the length m1 of the end tape 14 is preferably set greater than the length m2 of the tape feed path in this first preferred embodiment. Accordingly, at the ending of the heat-sensitive tape 15, a part of the end tape 14 is ejected from the tape eject portion A, so that the operator can reliably confirm the ending of the heat-sensitive tape 15 from the ejection of the end tape 14.

A second preferred embodiment of the present invention will now be described with reference to FIGS. 7 to 9, wherein an ink ribbon unit RU is used as the tape unit according to the present invention and it is stored in a tape cassette C. In a second preferred embodiment, the same parts as those in the first preferred embodiment are denoted by the same reference numerals, and the explanation thereof will be omitted.

Figure 7:
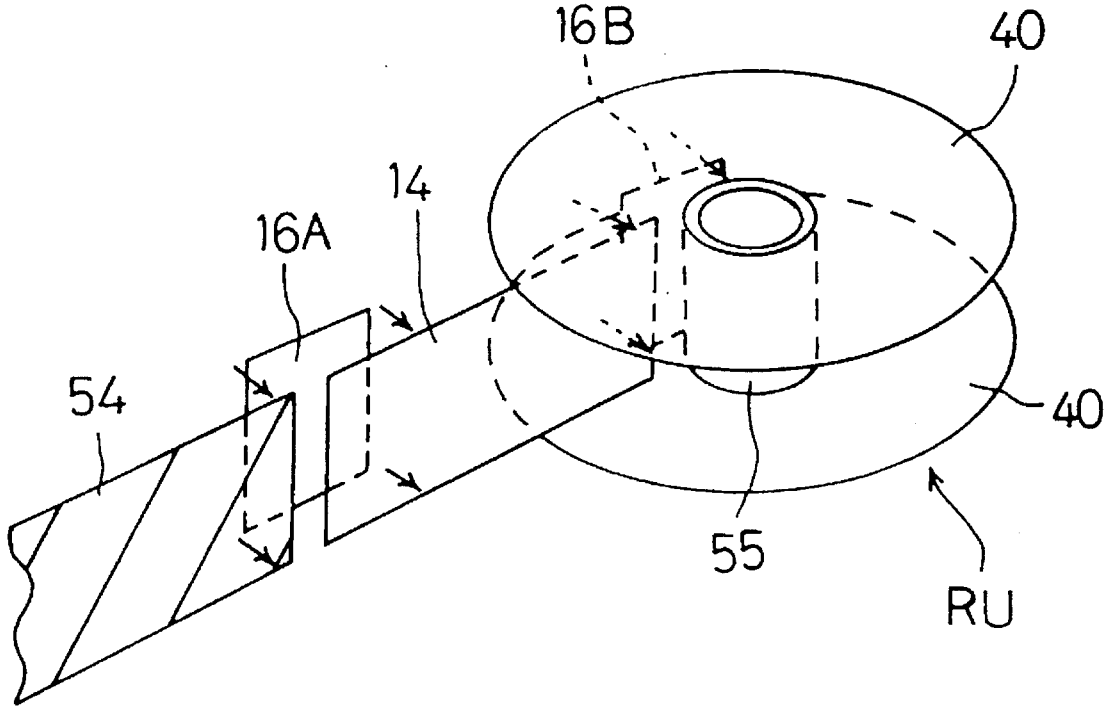
FIG. 7 is a partially cutaway perspective view of a tape unit according to a second preferred embodiment of the present invention.
Figure 8:
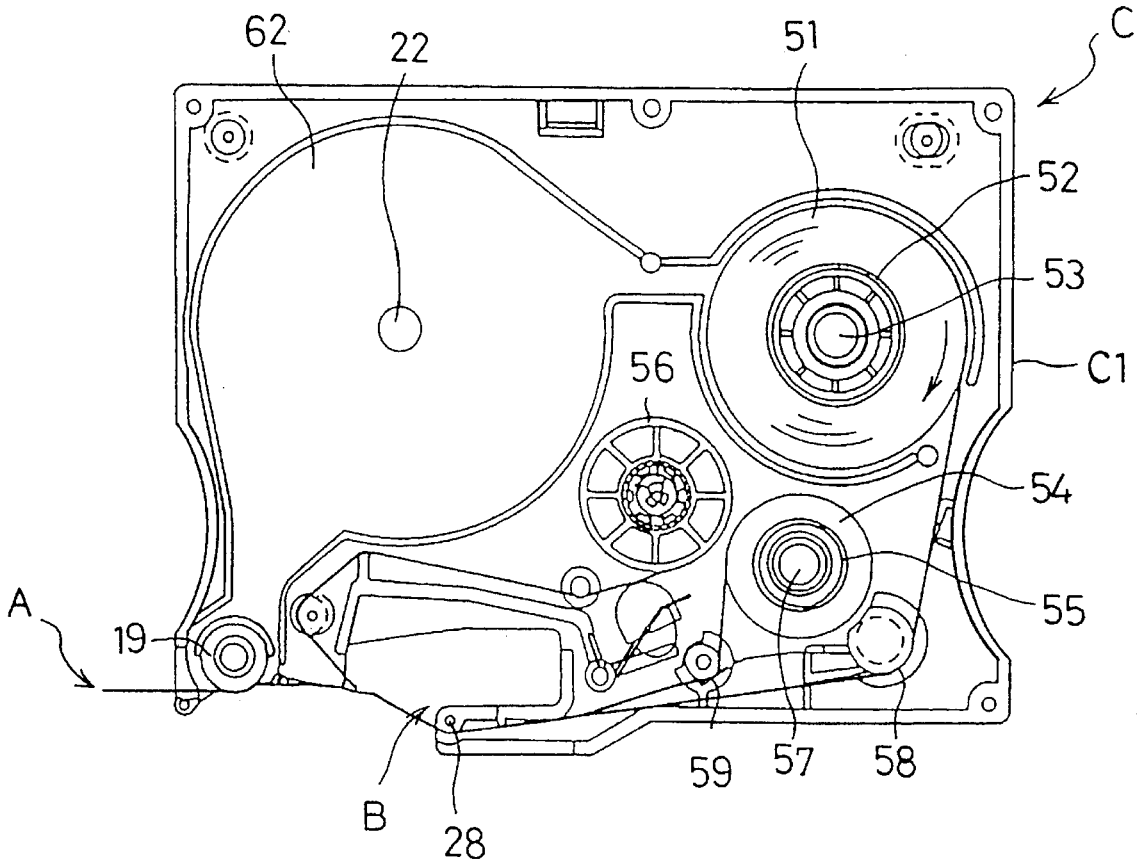
FIG. 8 is a top plan view of a tape cassette storing the tape unit shown in FIG. 7 with a cassette cover removed.

Referring to FIG. 7, the ink ribbon unit RU is composed of an end tape 14, a heat-sensitive ink ribbon 54 corresponding to the thermal recording material in the present invention, an ink ribbon spool 55 corresponding to the core in the pre;sent invention, and first and second adhesive tapes 16A and 16B. The ink ribbon 54 is formed by applying a thermal melting ink or a thermal sublimable ink to one surface of a plastic film such as a polyester film or a condenser paper.

The tape cassette C is set in a tape cassette receiving portion 1 as shown in FIG. 5. As shown in FIG. 8, a tape support shaft 53 is formed on the bottom surface of a cassette case C of the tape cassette C, and a tape spool 52 is rotatably mounted on the tape support shaft 53. A printing tape 51 is wound around the tape spool 52 to form a roll. Printing is effected on one surface of the printing tape 51 through the ink ribbon 54 by heat from a thermal head TH as shown in FIG. 5. An adhesive layer is formed on the other surface of the printing tape 51 opposite to the printing surface thereof, and a releasing paper is attached through the adhesive layer to the printing tape 51. The ink ribbon 54 and the end tape 14 are wound around the ribbon spool 55. The ribbon spool 55 is rotatably mounted on a tape support shaft 57 formed on the bottom surface of the cassette case C1. A ribbon take-up spool 56 to which a leading end of the ink ribbon 54 is fixed is rotatably supported to the cassette case C1 in such a manner that an engagement projection formed in a central hole of the ribbon take-up spool 56 is rotatably fitted in a hole formed through the bottom wall of the cassette case C1. When setting the tape cassette C in the tape cassette receiving portion 1 of the tape writer P, the ribbon take-up spool 56 comes into engagement with the drive shaft 3 provided in the tape cassette receiving portion 1 (see FIG. 5). The printing tape 51 drawn from the tape spool 52 is guided by guide members 58 and 28 to an opening portion B formed in the cassette case C1, whereas the ink ribbon 54 drawn from the ribbon spool 55 is guided by guide members 59 and 28 to the opening portion B. That is, the printing tape 51 and the ink ribbon 54 thus guided are joined to contact each other at a position upstream of the guide member 28, and printing is effected at the opening portion B by heat from the thermal head TH in such a manner that characters are transferred through the ink ribbon 54 to the printing tape 51 by the heat from the thermal head TH. Thereafter, only the printing tape 51 is ejected from a tape eject portion A of the cassette case C by the cooperation of a tape feed roller 19 and a tape feed auxiliary roller 31 (see FIG. 5). On the other hand, the ink ribbon 54 after printing is wound around the ribbon take-up spool 56.

In the tape cassette C, the printing surface of the printing tape 51 opposite to the surface on which the releasing paper is attached faces the surface of the ink ribbon 54 on which the ink is applied. When the tape cassette C is set in the tape cassette receiving portion 1 of the tape writer P, the printing tape 51 and the ink ribbon 54 are pressed against the thermal head TH by a platen 32 (see FIG. 5). In this condition, the printing tape 51 and the ink ribbon 54 are fed to effect printing of characters on the printing tape 51 by the heat from the thermal head TH.

In this second preferred embodiment, the length of the end tape 14 is preferably set greater than the length of a ribbon feed path from the ribbon spool 55 to the thermal head TH. Accordingly, at the ending of the ink ribbon 54, the end tape 14 comes into contact with the thermal head TH.

Figure 9:
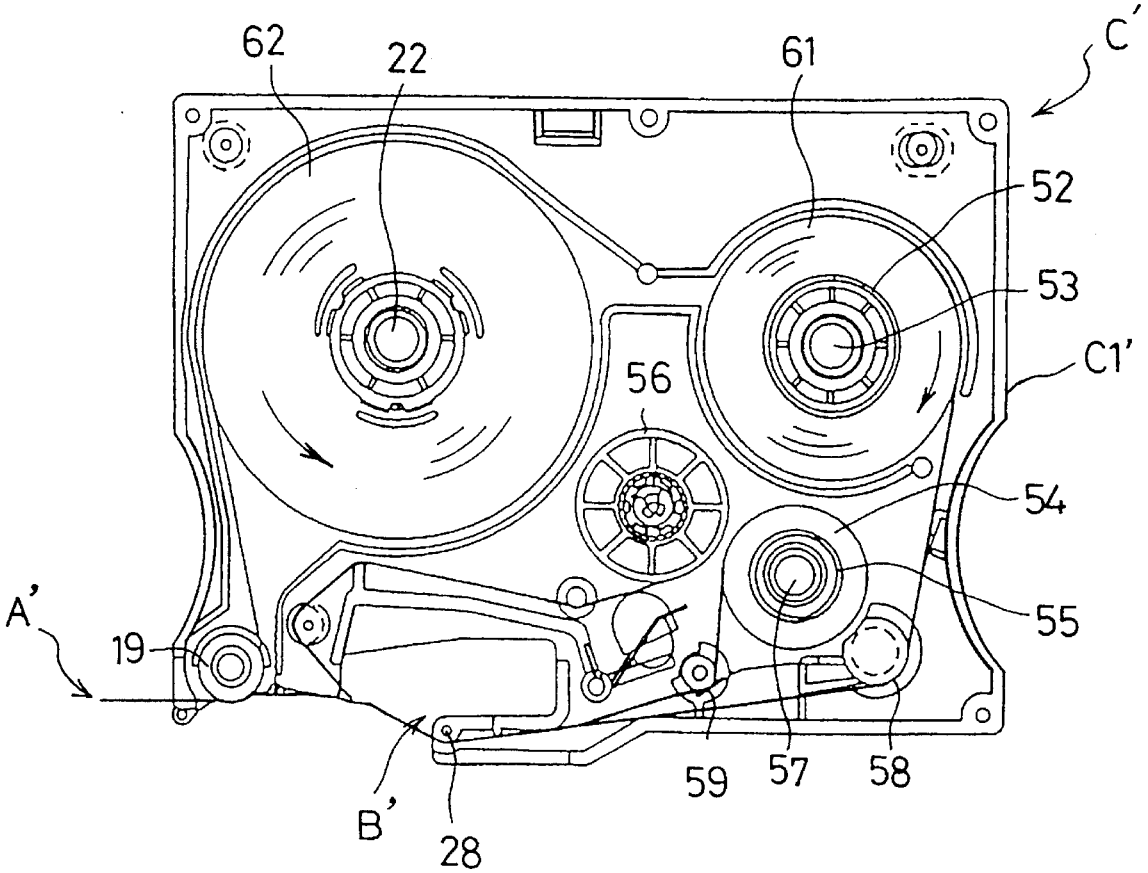
FIG. 9 is a view similar to FIG. 8, showing a modification of the tape cassette.

Referring to FIG. 9, there is shown a modification of the second preferred embodiment. In this modification, a tape cassette C' includes the same ink ribbon unit RU as mentioned above, a tape roll of a printing tape 61 formed as a transparent film, and a tape roll of a double-coated adhesive tape 62 on one surface of which a releasing paper is attached. The printing tape 61 drawn from the tape spool 52 is guided by guide members 58 and 28 to an opening portion B' formed in the cassette case C1', whereas the ink ribbon 54 drawn from the ribbon spool 55 is guided by guide members 59 and 28 to the opening portion B'. That is, the printing tape 61 and the ink ribbon 54 thus guided are joined to contact each other at a position upstream of the guide member 28, and printing is effected at the opening portion B' by heat from the thermal head TH in such a manner that characters are transferred through the ink ribbon 54 to the printing tape 61 by the heat from the thermal head TH. Thereafter, the printing tape 61 and the double-coated adhesive tape 62 are joined to contact each other and are ejected from a tape eject portion A' of the cassette case C1' by the cooperation of a tape feed roller 19 and a tape feed auxiliary roller 31 (see FIG. 5). On the other hand, the ink ribbon 54 after printing is wound around the ribbon take-up spool 56.

As similar to the first preferred embodiment, the end tape 14 of the ink ribbon unit RU according to a second preferred embodiment is preferably formed of a material having a glass transition point (Tg) of 90° C. or higher. Accordingly, even when heat from the thermal head TH is continuously applied to the end tape 14 at its same position, there is no possibility that the end tape 14 may be melted to stick to the thermal head TH, causing contamination of the thermal head TH, or may be cut to be entangled with any members surrounding the thermal head TH. Accordingly, even at the ending of the ink ribbon 54, a good condition of the tape writer P can be maintained.

What is claimed is:

1. A tape unit comprising:

an elongated thermal recording material that is capable of forming a printed image when used in a thermal recording system that employs a thermal print head;

a core for winding said thermal recording material; and an end tape connected to a trailing end of said thermal recording material, said end tape being connected to said core, and wherein a length of said end tape is greater than a length of a feed path of said thermal recording material from said core to at least the thermal print head, and wherein said end tape comprises a material that has a glass transition point (Tg) of at least 90° C. and is different from said thermal recording material.

2. The tape unit according to claim 1, wherein said end tape comprises a polyimide film having a thickness of 25 μm.

3. The tape unit according to claim 1, wherein said material forming said end tape is selected from the group consisting of PS (polysulfone), PES (polyether sulfone), PPS (polyphenylene sulfide), PEEK (polyetherether ketone), PAR (polyarylate), PEN (polyethylene naphthalate), APA (p-aromatic polyamide), PAI (polyamideimide), POD (polyoxazole), PHY (polyhydantoin), PPA (polyparabanic acid), PEI (polyether imide), and mixtures thereof.

4. The tape unit according to claim 1, wherein said thermal recording material comprises heat-sensitive recording paper or a heat-sensitive recording film.

5. The tape unit according to claim 1, wherein said thermal recording material comprises a heat-sensitive ink ribbon for transferring an original image to a recording medium.

6. The tape unit according to claim 1, wherein a width of said thermal recording material is equal to a width of said end tape.

7. A tape cassette comprising:

a cassette case having a tape eject portion;

a tape unit according to claim 1 stored in said cassette case; and feeding means for feeding the thermal recording material of the tape unit from the core of the tape unit to at least the thermal print head.

8. The tape cassette according to claim 7, wherein said thermal recording material comprises heat-sensitive recording paper or a heat-sensitive recording film.

9. The tape cassette according to claim 7, wherein said thermal recording material comprises a heat-sensitive ink ribbon for transferring an original image to a recording medium.

10. The tape cassette according to claim 8, wherein said core is detachably mounted in said cassette case, and a length of said end tape is greater than a length of a feed path of said thermal recording material from said core to said tape eject portion.

11. The tape cassette according to claim 9, wherein said core is detachably mounted in said cassette case.

12. The tape cassette according to claim 9, wherein said recording medium is supplied from a roll of a printing tape stored in said cassette case, said printing tape comprising a base, an adhesive layer formed on one surface of said base opposite to a printing surface thereof, and a releasing paper attached to said adhesive layer.

13. The tape cassette according to claim 9, wherein said recording medium is supplied from a roll of a printing tape stored in said cassette case, said printing tape comprising a transparent film, said tape cassette further comprising a roll of a double-coated adhesive tape on one surface of which a releasing paper is attached.

14. The tape unit according to claim 4, wherein said tape unit is contained in a cassette case having a tape eject portion.

15. The tape unit according to claim 14, wherein said core is detachably mounted in said cassette case.

* * * * *